US007316802B2

(12) United States Patent
Blankenstein et al.

(10) Patent No.: US 7,316,802 B2
(45) Date of Patent: Jan. 8, 2008

(54) DEVICE FOR THE STEPWISE TRANSPORT OF LIQUID UTILIZING CAPILLARY FORCES

(75) Inventors: Gert Blankenstein, Dortmund (DE); Ralf-Peter Peters, Bergisch Gladbach (DE)

(73) Assignee: Boehringer Ingelheim microParts GmbH, Dortmund (DE)

( * ) Notice: Subject to any disclaimer, the term of this patent is extended or adjusted under 35 U.S.C. 154(b) by 953 days.

(21) Appl. No.: 10/706,028

(22) Filed: Nov. 13, 2003

(65) Prior Publication Data

US 2004/0096358 A1 May 20, 2004

(30) Foreign Application Priority Data

Nov. 14, 2002 (DE) ..... 102 54 874

(51) Int. Cl.
*B01L 3/02* (2006.01)

(52) U.S. Cl. ..... 422/100; 103/57; 103/58

(58) Field of Classification Search ..... 422/99–101, 422/103, 57–58
See application file for complete search history.

(56) References Cited

U.S. PATENT DOCUMENTS

| | | | | |
|---|---|---|---|---|
| 3,799,742 | A | 3/1974 | Coleman | |
| 4,426,451 | A * | 1/1984 | Columbus | 436/518 |
| 4,806,316 | A * | 2/1989 | Johnson et al. | 422/100 |
| 4,849,340 | A | 7/1989 | Oberhardt | |
| 4,946,795 | A * | 8/1990 | Gibbons et al. | 436/179 |
| RE33,858 | E * | 3/1992 | Gropper et al. | 422/68.1 |
| 5,230,866 | A | 7/1993 | Shartle et al. | |
| 5,242,606 | A | 9/1993 | Braynin et al. | |
| 5,478,751 | A | 12/1995 | Oosta et al. | |
| 6,117,396 | A * | 9/2000 | Demers | 422/100 |
| 6,130,098 | A * | 10/2000 | Handique et al. | 436/180 |
| 7,010,391 | B2 * | 3/2006 | Handique et al. | 700/266 |
| 2002/0045265 | A1 * | 4/2002 | Bergh et al. | 436/37 |
| 2003/0210607 | A1 * | 11/2003 | Gilbert et al. | 366/152.1 |
| 2005/0186115 | A1 * | 8/2005 | Ichikawa et al. | 422/68.1 |
| 2005/0249641 | A1 * | 11/2005 | Blankenstein et al. | 422/102 |
| 2006/0188396 | A1 * | 8/2006 | Bedingham et al. | 422/57 |

FOREIGN PATENT DOCUMENTS

| | | |
|---|---|---|
| WO | WO 99/46045 | 9/1999 |

* cited by examiner

*Primary Examiner*—Brian R. Gordon
(74) *Attorney, Agent, or Firm*—Diller, Ramik & Wight

(57) ABSTRACT

The device (10) for the stepwise transport of liquid, particularly of sample liquid to be analyzed, through several reaction chambers located in series in terms of flow while utilizing capillary forces comprises at least one channel (14) through which liquid is transportable on the basis of capillary forces. Further, the device (10) comprises at least two closed vent holes (38,40,42) which are in fluid communication with the channel (14) at connection sites (22,24,26) spaced from each other along the channel (14). The connection sites (22,24,26) divide the channel (14) into several channel sections (44,46,48). The fluid connections between a respective channel section (44,46,48) and the vent holes (38,40,42) allocated thereto can be opened separately.

12 Claims, 2 Drawing Sheets

DEVICE FOR THE STEPWISE TRANSPORT OF LIQUID UTILIZING CAPILLARY FORCES

BACKGROUND OF THE INVENTION

1. Field of the Invention

The invention relates to a device for the stepwise transport of liquid through several flow chambers located in series in terms of flow while utilizing capillary forces, the liquids preferably being sample liquids to be analyzed.

In the most different application fields of analytics and diagnostics, it is required to analyze sample liquids. The assays used therefor sometimes require that the sample liquids are sequentially brought into contact with different reagents. With respect to the automation of such assays, it is advantageous to be able to transport the sample liquid to be analyzed in a stepwise manner.

2. Description of Related Art

In the state of the art, it is basically known to initiate the transport of liquid through a channel and in order to fill a chamber by deaerating the channel and the chamber, respectively, whereby a liquid flow is created. Examples for such selective liquid flow mechanisms are described in International Patent No. 99/46045, International Patent No. 01/64344, U.S. Pat. No. 4,849,340, U.S. Pat. No. 5,230,866, U.S. Pat. No. 5,242,606 and U.S. Pat. No. 5,478,751.

Further, U.S. Pat. No. 3,799,742 describes a fluid system where a liquid flow from a reservoir into the individual chambers is caused by utilizing gravity and the selective deareation of individual chambers connected in series and in parallel. In this known device, a liquid channel extends from a reservoir. Along this liquid channel, several branch channels branch off which end in two chambers connected in series. At the level of the junction of the branch channels to the chambers, vent lines branch off them all of which are closed and can be opened selectively. The afore-described channel system allows for a liquid transport exclusively by the utilization of gravity. As long as all vent holes are closed, the liquid transport from the reservoir is prevented by retaining the liquid by the gas counterpressure. When the chamber of the two chambers per branch channel which is arranged first in flow direction is aerated, liquid from the reservoir can flow into this chamber. By installing a gas-permeable filter that is hydrophobic with respect to the liquid, it is ruled out that the liquid escapes from the vent line of this chamber. Passing into the second chamber arranged downstream is prevented by the fact that this chamber is not deaerated. Only if this chamber is deaerated, liquid enters into the second chamber as well. This known system requires the substantially vertical orientation of the substrate in which the channel system is configured. This restricts the application of the system inasmuch as no liquid transport can be effected when the substrate is in the horizontal state since it lacks the gravity component initiating the liquid flow.

SUMMARY OF THE INVENTION

It is an object of the invention to provide a device for the stepwise transport of liquid, particularly of sample liquid to be analyzed, which is of quite a simple structure as well as comfortably and simply operable and which works reliably.

To solve this object, the invention suggests a device for the stepwise transport of liquid, particularly of sample liquid to be analyzed, through several reaction chambers located in series in terms of flow while utilizing capillary forces, which is provided with

- at least one channel through which liquid is transportable on the basis of capillary forces, and
- at least two closed vent holes which are in fluid communication with the channel at connection sites spaced from each other along the channel,
- the connection sites dividing the channel into several channel sections,
- the fluid connections between a respective channel section and the vent holes allocated thereto being able to be opened separately, and
- at least one chamber being arranged in the channel sections upstream of each connection site in flow direction.

According to the invention, capillary forces are utilized for the stepwise transport of liquids. To this end, the channel of the device through which the liquid is to be transported is designed correspondingly. This applies to the cross-sectional areas, designs of the cross-sectional areas and surface structures of the channel. The channel is in fluid communication with at least two vent holes that are closed in their initial state. The fluid connection of the vent holes with the channel is effected at connection sites spaced from each other along the channel. The vent holes may directly form the connection sites, i.e., be directly arranged in the channel wall or a substrate in which the channel is formed. Alternatively, vent channels may branch off the connection sites which end in the vent holes. The vent channels may be designed for the liquid transport by means of capillary forces. This, however, is not necessarily so since the vent holes primarily serve venting.

If now liquid enters into the channel by the channel extending, for example, from a sample receiving chamber, the transport of liquid through the channel is prevented as long as the channel (at its end) and the vent holes are closed. When the first vent hole in flow direction of the channel is opened, liquid flows up to the connection site of the channel being in fluid communication with the opened vent hole and, in doing so, fills the chamber located upstream of this connection site; the further transport of the liquid through the channel beyond this connection site is not possible since the following part of the channel is outwardly closed. Only when the next vent hole in flow direction is opened, the channel section between the afore-mentioned connection site and, the connection site allocated to the next vent hole as well as the chamber arranged in this channel section are filled with liquid. The chambers may be empty or equipped with substances, insets (porous bodies or the like) or means producing capillary forces, such as surface structures.

By the above-described concept, it is thus possible in a rather simple manner, namely only by opening vent holes, to transport a liquid through a channel with successively arranged chambers selectively and in a stepwise manner. If reagent substances or reagents are arranged in the individual channel sections or chambers, it is hence possible to subject the liquid to a previously defined succession of reactions. By finally opening the last vent hole, the sample liquid could be introduced into an analyzing chamber or the like reservoir in which an analysis (e.g., photo-technical analysis) of the sample liquid can be effected in the most different ways. It is also possible, however, to already make (intermediate) analyses in the other reaction chambers. Generally, analyses are made, e.g., photo-technically (optically), particularly by detecting the transmission or change of color of the sample liquid, or microscopically.

In an advantageous embodiment of the invention, it is provided that reagents, preferably immobilized, are arranged within the chambers located in the individual channel sections. By the contact with the liquid, the reagents are mobilized and can react with the liquid.

In the most simple case, the vent holes may be arranged directly in the wall of the channel. Hence, the connection sites coincide with the vent holes. Alternatively, it is also possible that venting channels ending in the vent holes branch off the connection sites.

(Re)closing the vent holes after the liquid front has passed the allocated connection sites of the channel is not absolutely necessary but may be well effected. It is more useful, however, when the liquid succeeds in flowing up to the vent hole at maximum and it is ensured that the liquid cannot escape from the vent hole. This is possible without any problems with mechanisms utilizing capillary forces for the transport of liquid. With respect thereto, it is useful again when the vent holes are dimensioned correspondingly so that an escape of the liquid from the holes is eliminated due to liquid surface tensions produced. In this case, the transport through a vent channel leading from a connection site to the vent hole is usefully also performed by utilizing capillary forces. Alternatively or additionally, a capillary stop may be located upstream of the vent hole. It may be configured, for example, as an hydrophobic (partial) surface of the vent channel or as an hydrophobic vent hole or as a stepwise flare of the channel system.

Usefully, the vent holes are opened selectively by means of separate cover elements or one common cover element by means of which the vent holes can be selectively uncovered in correspondence with their arrangement along the channel. In the most simple case, the cover element is a piece of adhesive tape adhered across one or more vent holes. In order to open a vent hole, the cover element may be, for example, adapted to be pulled off or punctured. As an alternative, it is also possible that the cover element can be melted open or will be dissolved or becomes air-permeable by initiating a reaction. In the most simple case, the cover element is a piece of adhesive tape placed on the vent holes of the substrate or the like carrier in which the channel system according to the invention is formed. For melting open the cover elements, it is advantageous, for example, when these cover elements are thermally coupled with one or more heating elements. By driving the heating elements, cover elements are thus selectively melted open and thus, vent holes are uncovered.

The initiation of a reaction dissolving a cover element can be effected by the contact of the cover element with a reaction agent from outside. Only reaction compounds inert for the sample liquid should be produced. As a cover element, for example, a hydrophilic material (e.g., gel such as agarose, sucrose or the like polysaccharides) is used. After the cover element has been dissolved by application from outside, the sample liquid comes into the next channel section. Hence, in this case, the cover elements are arranged directly behind a vent hole or a connection site in flow direction so that a channel section uncovered by a dissolved cover element can be deaerated via the vent hole allocated thereto.

The device according to the invention can be used, for example, for a blood test wherein the blood to be analyzed reacts with a first antibody or a conjugate in a first reaction chamber and subsequently bind second antibodies to the bound first antibodies in a second chamber. Starting from a blood sample receiving chamber or the like receptacle for the blood to be analyzed, the latter then passes the channel section of the channel extending up to the allocated connection site after the first vent hole has been uncovered, in which channel section the first reaction chamber with the first antibodies or the conjugate is arranged. After a specified dwelling time, the blood sample to be analyzed with the partially bound antibodies is transferred into a second channel section by uncovering the next vent hole in flow direction, in which second channel section the second reaction chamber with the second antibodies is arranged. Subsequently, by uncovering a further vent hole or by uncovering the end of the channel, the sample liquid may be transported further therein or transported out of it.

Advantageously, the device according to the invention may also comprise several of the afore-described (sample liquid transport) channels with vent holes. In terms of flow, all of these channels are parallel to each other, extend from a sample reception array with a common sample receiving chamber or several separate sample receiving chambers respectively allocated to the channels and preferably comprise channel sections of the same length between the individual connection sites. In this connection, the vent holes allocated to the respective connection sites are arranged in immediate adjacency and can be advantageously uncovered with one and the same cover element. Thereby, a parallel stepwise transport of liquid through the individual channels is permitted.

BRIEF DESCRIPTION OF THE DRAWINGS

Hereinafter, the invention will be explained in detail with respect to several embodiments thereof with reference to the drawings.

DESCRIPTION OF THE PREFERRED EMBODIMENTS OF THE INVENTION

Figure 1:
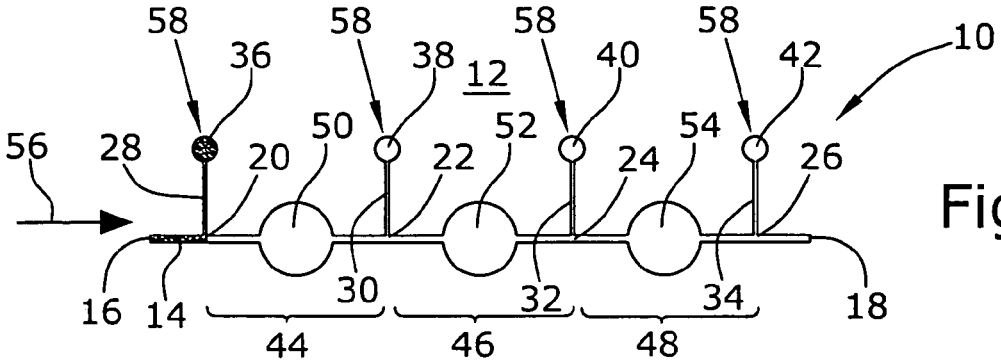
FIG. 1 shows a first embodiment for a channel structure according to the invention, for the stepwise transport of liquid while utilizing capillary forces.

FIG. 1 shows the basic structure of the capillary channel system 10 according to the invention. The capillary channel system 10 is formed in a substrate 12 (plastic body or the like) and comprises a channel 14 comprising an inlet opening 16 being in fluid communication with a reservoir not shown and an outlet opening 18. Liquid in the channel 14 is transported in the channel while utilizing capillary forces.

The channel 14 comprises several connection sites 20,22, 24 and 26 (four in the embodiment) from which vent lines 28,30,32,34 branch off which end in vent holes 36,38,40,42. By the connection sites 20,22,24,26, the channel 14 is divided into separate channel sections 44,46,48; in each channel section 44,46,48, there is a reaction chamber 50,52, 54.

The capillary channel system 10 shown in FIG. 1 can be selectively filled with liquid as follows.

In the initial state, all vent holes 36,38,40,42 as well as the outlet 18 of the channel 14 are closed. If the first vent hole 36 in flow direction 56 (see arrow) is opened, sample liquid awaiting at the inlet 16 of the channel 14 comes up to the connection site 20 as well as into the vent channel 28 up to the vent hole 36. By shortening the vent channels 28, the dead volume of the capillary channel system 10 can be minimized. The vent holes 36 may also be directly formed in the wall of the channel 14. This means that after the hole 36 has been uncovered, the liquid front within the channel 14 migrates to the connection site 20; in any case, no liquid comes into the channel section 44 (yet).

Figure 2:
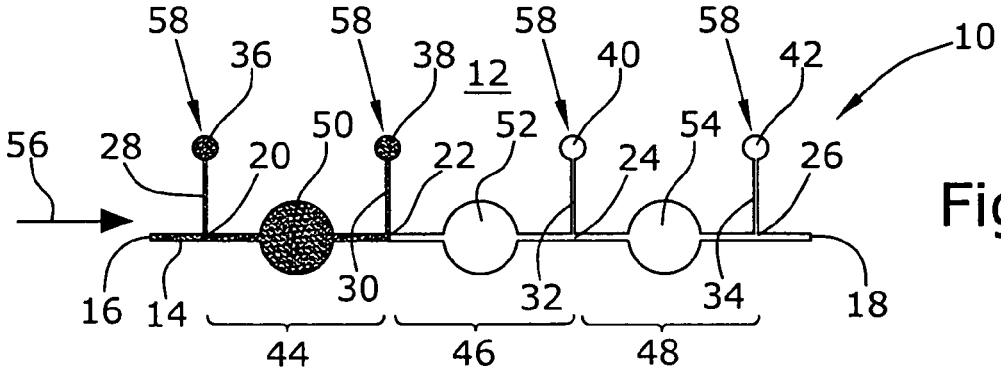
FIGS. 2 to 4 show the individual phases in which the channel structure according to FIG. 1 is illustrated after the individual vent holes arranged along the channel have been opened successively.

If, however, the next vent hole 38 in flow direction is subsequently uncovered, liquid reaches the second channel section 44 and fills up the latter, which means that also the reaction chamber 50 is filled up with liquid to be analyzed. The advancing liquid front comes to a standstill in the channel at the connection site 22, from there, the liquid only flows into the vent channel 30 up to the vent hole 38. This state is represented in FIG. 2.

Figure 3:
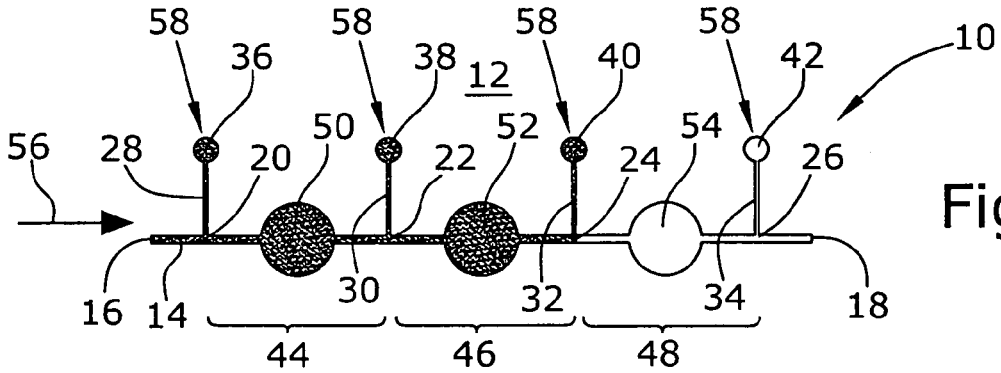
Figure 4:
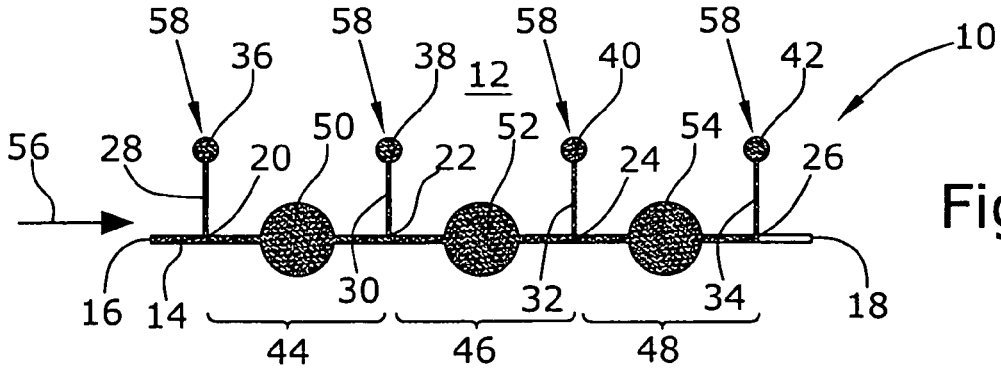

If now the next vent opening 40 is opened, the afore-described procedure is repeated for the further channel section 46 so that finally, the situation according to FIG. 3 arises. By uncovering the next vent hole 42, the next channel section 48 is finally filled up with liquid, which is shown in FIG. 4. If the outlet 18 of the channel 14 is opened subsequently, the liquid flows from the channel 14 into a (non-illustrated) receptacle or a receiving chamber.

The afore-described capillary channel system 10 may also be provided with so-called capillary stops which are only overcome after a pressure pulse has been impressed on the liquid, the further transport of the liquid being subsequently induced by capillary forces again. Such capillary stops could be formed or arranged at the exits of the reaction chambers 50,52,54, for example. In such a case, the selective transport of the liquid through the capillary channel system 10 is thus alternately effected by uncovering vent holes and impressing a pressure pulse.

It has to be pointed out that, according to the invention, it is not absolutely necessary that a vent hole 36 is arranged before the first reaction chamber 50. It could be omitted together with the vent line 28 as shown in FIGS. 5 to 7.

Figure 5:
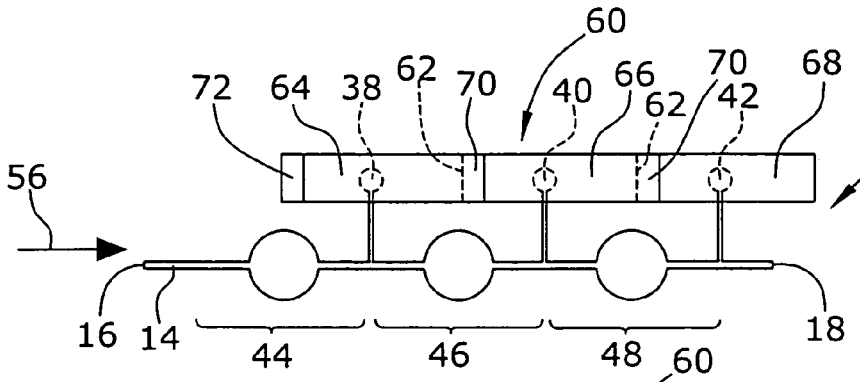
FIG. 5 shows a second embodiment of a channel structure according to the invention.
Figure 6:
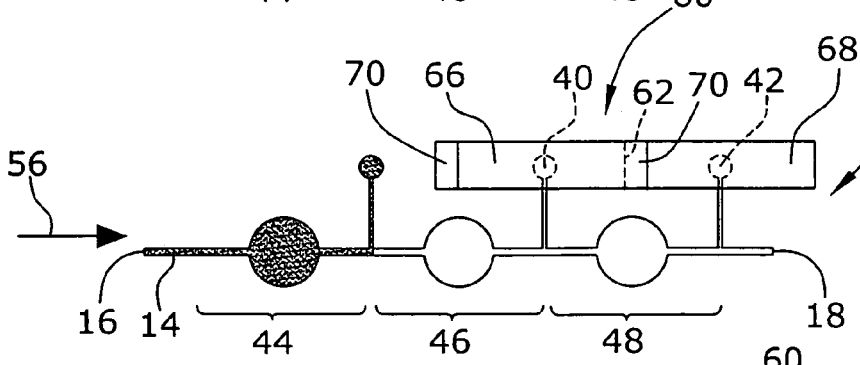
FIGS. 6 and 7 show the individual phases in which the channel structure according to FIG. 5 is illustrated after the individual vent holes arranged along the channel have been opened successively.
Figure 7:
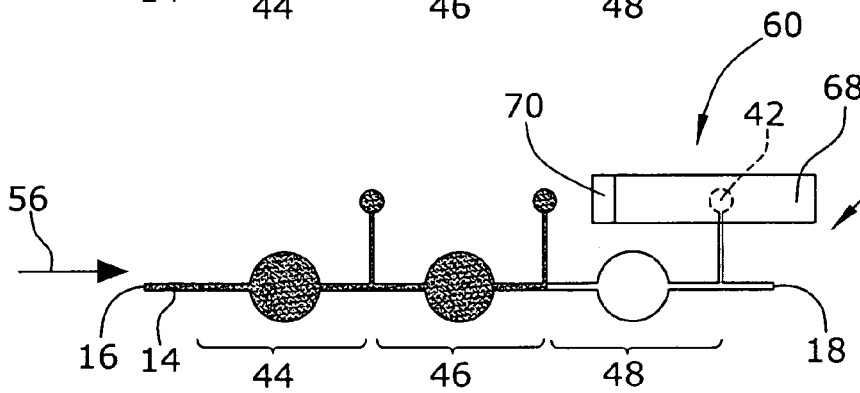

In FIGS. 5 to 7, a second embodiment of a capillary channel system 10' is illustrated. The basic structure of the capillary channel system 10' of FIGS. 5 to 7 is identical to that according to FIGS. 1 to 4. A difference consists in the manner of uncovering the vent holes. In the embodiment according to FIGS. 1 to 4, for example, they were uncovered by individual cover elements 58, whereas a continuous cover strip 60 is provided in the embodiment according to FIGS. 5 to 7, which is pulled off to a greater or lesser degree and thus uncovers the vent holes 36,38,40,42 little by little. The cover strip 60 may be configured as an adhesive tape comprising separate partial sections 64,66,68 connected by perforation lines or other kinds of rated breaking lines 62. The rated breaking lines 62 are respectively located between two adjacent vent holes 38,40 and 40,42, respectively, and advantageously about in the middle between these holes. At least at the side of a rated breaking line 62, which points to the next vent hole downstream, the adhesive surface of the cover strip is free of adhesive in a portion 70 adjacent to the rated breaking line 62. After detaching the first partial section 64 having a non-adhesive portion 72 at its free end, which serves as a finger lift, this partial section 64 can be torn off at the rated breaking line. Then, the portion 70 of the next partial section 66 in turn serves as a finger lift for facilitating the detachment of the partial section 66 for the purpose of uncovering the next vent hole 40.

Figure 8:
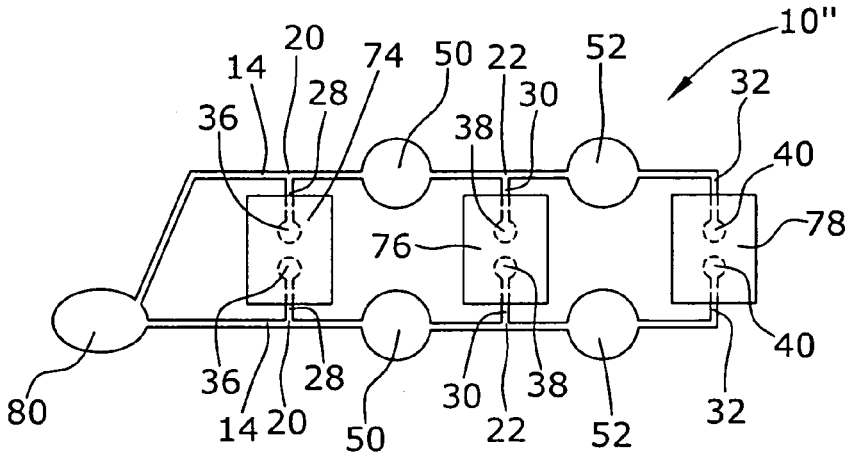
FIG. 8 shows a third embodiment of a channel structure according to the invention for the successive parallel transport of liquids through several channels.

Finally, FIG. 8 shows a further embodiment of the capillary channel system 10" according to the invention which comprises several (two in this embodiment) channels 14 each of which is constructed and designed as described in connection with the previous embodiments, i.e., it comprises several reaction chambers 50,52 (two in this embodiment) connected in series in terms of flow. This means that several vent lines 28,30,32 with vent holes 36,38,40 at their ends branch off from each channel 14. Of all the channels 14, the first vent holes 36 in flow direction are closed, in groups or all, by several cover elements or one common cover element 74. The same constellation arises for the next vent holes 38,40 in flow direction, which are closed by a cover element 76 and 78, respectively. Viewed over the entire capillary channel system 10", this system of common cover elements 74,76,78 or cover elements in common for groups of them is the same.

By the cover elements 74,76,78, it is now possible to respectively initiate and perform the stepwise liquid transport through all the channels 14 simultaneously and parallel. The purpose of the vent holes 36 of the channels 14 arranged upstream of the first reaction chambers 50 in flow direction becomes clear upon considering that the channels 14 may have a different length in their sections between the reservoir 80 and the first reaction chambers 50 (due to construction, for example). The connection sites 20 of the channels 14 where the vent lines 18 branch off are arranged at the same distance from the first reaction chambers 50 along the channel 14. After the first vent holes 36 have been uncovered, the liquid front advances by the same distance from the first reaction chamber 50 in each channel 14. Thus, the simultaneous filling of the first reaction chambers 50 after the uncovering of the second vent holes 38 is ensured.

Alternatively, a common cover element may be provided for all vent holes which gradually uncovers vent holes (in correspondence with the cover element of the embodiment according to FIGS. 5 to 7). Further, it may be alternatively provided in the embodiment according to FIG. 8 that the vent channels 28,30,32 branching off from the sample liquid transport channels 14 end in a common vent hole 36,38,40 by groups (the first group comprises the first vent channels 28 in flow direction, the second group the second vent channels 30 in flow direction and so forth).

As mentioned in connection with the first embodiment according to FIGS. 1 to 4, the capillary channel systems 10' and 10" of FIGS. 5 to 8 may also be additionally provided with capillary stops which, as also mentioned above, are arranged, for example, at the outlet end of the reaction chambers 50,52 when viewed with respect to the flow direction.

A feature of the capillary channel system according to the invention is a precise timing and triggering of the further transport of the liquid. Further, extremely simple opening mechanisms for the vent holes are described. Usefully, the system is designed for being used once and conceived as a throw-away article. A minimum of sample liquid is used and no filter/membrane components are used at all, either. Further, the system permits the completely closed configuration on a substrate or the like carrier, for which reason the risk as to contamination is reduced. For triggering the reactions and particularly the transport of the liquid, no centrifugal forces or the like are required. The operation of the system according to the invention is independent of its position since capillary forces are utilized for the liquid transport.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A device for the stepwise transport of liquid, particularly of sample liquid to be analyzed, through several reaction chambers located in series in terms of flow while utilizing capillary forces, comprising a channel (14) through which liquid is transportable on the basis of capillary forces, and at least two closed vent holes (38,40,42) which are in fluid communication via respective fluid connections (30,32,34) with the channel (14) at connection sites (22,24,26) spaced from each other along the channel (14), the connection sites (22,24,26) dividing the channel (14) into several channel sections (44,46,48), the vent holes (38,40,42) allocated thereto being able to be opened separately, thereby allowing stepwise fluid flow into said respective channel sections (44,46,48), and at least one chamber (50,52,54) being arranged in the channel sections (44,46,48) upstream of each connection site (22,24,26) in flow direction.

2. The device according to claim 1, characterized in that a reagent substance is arranged in at least one chamber (50,52,54).

3. The device according to claim 2, characterized in that the reagent substance is immobilized and adapted to be mobilized when contacting the liquid.

4. The device according to claim 1, characterized in that said fluid connections are vent channels (30,32,34) ending in the vent holes (38,40,42) and branch off from the channel (14) at the connection sites (22,24,26).

5. The device according to claim 4, characterized in that liquid is transportable through the vent channel (30,32,34) up to the vent hole (38,40,42) by capillary effect when the vent hole (38,40,42) is open.

6. The device according to claim 1 characterized in that a liquid flowing through the channel section (44,46,48) upstream of the vent hole (38,40,42) when viewed in flow direction after the vent hole (38,40,42) has been opened reaches up to the vent hole (38,40,42).

7. The device according to claim 1 characterized in that each vent hole (38,40,42) is closed by a cover element (60,74,76,78) that is adapted to be pulled off, punctured, melted open and/or soluble or air-permeable by initiating a reaction.

8. The device according to claim 7, characterized in that all the vent holes (38,40,42) are covered by a common cover element (60,74,76,78), the cover element (60,74,76,78) being adapted to be selectively pulled off, punctured, melted open and/or soluble or air-permeable by initiating a reaction.

9. The device according to claim 7 characterized in that one or more heating elements thermally coupled with the cover element (60,74,76,78) are provided for melting open the cover element (60,74,76,78).

10. The device according to claim 1 characterized in that several channels (14) are provided the first, second and further vent holes (38,40,42) of which, which succeed each other in flow direction, are respectively adapted to be uncovered in common in groups.

11. The device according to claim 1 characterized in that the vent holes (38,40,42) are capillary holes.

12. The device according to claim 8, characterized in that one or more heating elements thermally coupled with the cover element (60,74,76,78) are provided for melting open the cover element (60,74,76,78).

* * * * *